US008636281B2

(12) United States Patent
Kim

(10) Patent No.: US 8,636,281 B2
(45) Date of Patent: Jan. 28, 2014

(54) IMAGE FORMING APPARATUS WITH PLURAL DISCHARGE PATHS

(75) Inventor: Min Hoi Kim, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 13/242,492

(22) Filed: Sep. 23, 2011

(65) Prior Publication Data

US 2012/0086166 A1 Apr. 12, 2012

(30) Foreign Application Priority Data

Oct. 7, 2010 (KR) ..... 10-2010-0097575

(51) Int. Cl.
*B65H 29/66* (2006.01)
*B65H 31/04* (2006.01)
*G03G 21/00* (2006.01)

(52) U.S. Cl.
USPC ..... 271/213; 271/65; 271/207; 399/124; 399/405

(58) Field of Classification Search
USPC ..... 271/303, 301, 65, 207, 213; 399/124, 399/405
See application file for complete search history.

(56) References Cited

U.S. PATENT DOCUMENTS

| | | | | |
|---|---|---|---|---|
| 4,750,016 | A * | 6/1988 | Kusumoto et al. | 399/405 |
| 5,586,758 | A * | 12/1996 | Kimura et al. | 271/303 |
| 6,553,207 | B2 * | 4/2003 | Tsusaka et al. | 399/401 |
| 6,953,192 | B2 * | 10/2005 | Jang | 271/213 |
| 7,079,806 | B2 * | 7/2006 | Baek et al. | 399/405 |

* cited by examiner

*Primary Examiner* — Luis A Gonzalez
(74) *Attorney, Agent, or Firm* — Stanzione & Kim, LLP

(57) ABSTRACT

An image forming apparatus including a main body, a first guide member coupled to the main body so as to be rotated from a first position to a second position, and a second guide member rotatably coupled to the first guide member. The first guide position defines a first paper discharge path to discharge paper, a printed surface of which is inverted, when it is in the first position. The first guide member defines a second paper discharge path, along which the printed surface of the paper is directly discharged, when it is pivotally rotated from the first position to the second position. The second guide member guides the paper on the first paper discharge path and does not interfere with the paper on the second paper discharge path.

29 Claims, 11 Drawing Sheets

IMAGE FORMING APPARATUS WITH PLURAL DISCHARGE PATHS

CROSS-REFERENCE TO RELATED APPLICATIONS

This application claims the benefit of priority under 35 U.S.C. §119 to Korean Patent Application No. 10-2010-0097575, filed on Oct. 7, 2010 in the Korean Intellectual Property Office, the disclosure of which is incorporated herein by reference in its entirety.

BACKGROUND OF THE INVENTION

1. Field of the Invention

The present general inventive concept generally relates to an image forming apparatus, and more particularly to an image forming apparatus having an improved structure to provide a discharge path of printing media.

2. Description of the Related Art

An image forming apparatus is designed to form an image on a printing medium based on an input image signal. Examples of image forming apparatuses include printers, copiers, fax machines, and devices combining functions thereof.

An electro-photographic image forming apparatus, which is a kind of image forming apparatus, includes a photoconductor, a light scanning device, and a developing device. The light scanning device irradiates light to a photoconductor that has been charged with a predetermined potential, thereby forming an electrostatic latent image on a surface of the photoconductor. The developing device feeds developer to the electrostatic latent image, thereby forming a visible image.

The visible image formed on the photoconductor may be directly transferred to a printing medium, or may be indirectly transferred to the printing medium by way of an intermediate transfer device. The printing medium, on which the image has been printed, is subjected to fusing.

Then, the printing medium, on which the image has been fused, is discharged to the outside of the image forming apparatus through a predetermined paper discharge path.

SUMMARY OF THE INVENTION

The present general inventive concept provides an image forming apparatus to ensure that print media discharged from the image forming apparatus is stacked without being bent.

The present general inventive concept also provides an image forming apparatus to provide a sufficient space for print media discharged from the image forming apparatus to be stacked.

Additional aspects and advantages of the present general inventive concept will be set forth in part in the description which follows and, in part, will be obvious from the description, or may be learned by practice of the general inventive concept.

The foregoing and/or other features and utilities of the present general concept may be realized by providing an image forming apparatus, which has a first paper discharge path to discharge paper in which a printed surface of the paper is inverted, and a second paper discharge path, along which the printed surface of the paper is directly discharged. The image forming apparatus includes a main body, a first guide member coupled to the main body so as to be pivotally rotated from a first position to a second position, and a second guide member coupled to the first guide member such that the second guide member can pivotally rotate with respect to the first guide member, wherein the first guide member defines the first paper discharge path when it is in the first position and the second paper discharge path when it is pivotally rotated from the first position to the second position, and wherein the second guide member includes a guide edge to guide the paper to be discharged along the first paper discharge path and does not interfere with the paper to be discharged along the second paper discharge path.

The second guide member may include an avoidance surface to prevent the second guide member from interfering with the paper to be discharged along the second paper discharge path, and the avoidance surface may be arranged to face the first guide member so as to guide the paper on the first paper discharge path when the first guide member is in the first position, and is arranged obliquely to the first guide member so as not to interfere with the paper on the second paper discharge path when the first guide member is located in the second position.

The avoidance surface may have a greater radius of curvature than a radius of curvature of the guide edge.

The second guide member may include a clasp protruding from one side thereof and a hook provided near the clasp, and the first guide member may include a retainer provided at a position corresponding to the hook.

The hook may be coupled with the retainer when the first guide member is in the first position and may be released from the retainer when the first guide member is in the second position.

The image forming apparatus may further include a lever provided in the main body, and the lever may include a first pressure portion to apply pressure to a front surface of the clasp so as to pivotally rotate the second guide member when the first guide member is pivotally rotated from the first position to the second position, and a second pressure portion to apply pressure to a rear surface of the clasp so as to pivotally rotate the second guide member when the first guide member is pivotally rotated from the second position to the first position.

The second pressure portion may come into contact with a rear surface of the second guide member to restrict pivotal rotation of the second guide member when the first guide member is in the second position.

The first pressure portion and the second pressure portion may be integrally formed with each other to have an acute angle therebetween.

The second guide member may be pivotally rotated in an opposite direction of a pivotal rotating direction of the first guide member when the first guide member is pivotally rotated between the first position and the second position.

The image forming apparatus may further include a string provided at one surface of the first guide member, and the string may include a coupling portion coupled to the second guide member, a grip portion to receive a user force to pull the string, and a connecting portion to connect the coupling portion and the grip portion to each other.

The clasp may include a coupling piece protruding from a rear surface thereof, and the coupling portion may be provided with a coupling hole to couple with the coupling piece.

The first guide member may be provided at one surface thereof with a stopper, the stopper being shaped to surround the connecting portion.

The grip portion and the stopper may come into contact with each other to restrict pivotal rotation of the second guide member.

The foregoing and/or other features and utilities of the present general concept may be also realized by providing an image forming apparatus, which has paper discharge paths along which paper is discharged, and includes a main body, a cover rotatably coupled to the main body to open or close the main body, the cover being rotatable between a closed position and an open position, a guide rib provided at an inner surface of the cover, and a rotating member rotatably coupled to the cover, wherein the guide rib defines a first paper discharge path when the cover is in the closed position and a second paper discharge path when the cover is rotated from the closed position to the open position, and wherein the rotating member includes a guide edge to guide the paper to be discharged along the first paper discharge path and does not interfere with the paper to be discharged along the second paper discharge path.

The rotating member may include the guide edge to define the first paper discharge path along with the guide rib when the cover is in the closed position, and an avoidance surface arranged so as not to interfere with the paper to be discharged along the second paper discharge path when the cover is in the open position to define the second paper discharge path.

The avoidance surface may have a greater radius of curvature than a radius of curvature of the guide edge.

The image forming apparatus may further include a clasp provided at one side of the rotating member, a hook provided beneath the clasp, and a retainer protruding from the inner surface of the cover and having a recess having a shape corresponding to that of the hook, wherein the hook is coupled with the recess when the cover is in the closed position and is released from the recess when the cover is in the open position.

The image forming apparatus may further include a lever to rotate the rotating member, the lever may include a guide body, a pressure protrusion formed at one end of the guide body, and a pressure surface defining an inner surface of the guide body, the pressure protrusion may apply pressure to a front surface of the clasp such that the rotating member is rotated in an opposite direction of a rotating direction of the cover when the cover is rotated from the closed position to the open position, and the pressure surface may apply pressure to a rear surface of the clasp such that the rotating member is rotated in an opposite direction of a rotating direction of the cover when the cover is rotated from the open position to the closed position.

The pressure surface may come into contact with a rear surface of the rotating member to restrict pivotal rotation of the rotating member when the cover is in the open position.

The image forming apparatus may further include a string member to rotate the rotating member, and the string member may include a body, a coupling hole formed in one end of the body to couple the string member to the rotating member, and a grip provided at the other end of the body to receive a user force to pull the string member.

The clasp may include a coupling piece protruding from a rear surface thereof so as to be fitted into the coupling hole.

The rotating member may be rotated in linkage with the string member when the string member is pulled by the user.

The cover may be provided at the inner surface thereof with a stopper, and the stopper and the grip may come into contact with each other to restrict rotation of the rotating member.

The foregoing and/or other features and utilities of the present general concept may be also realized by providing an image forming apparatus having a first paper discharge path to discharge paper toward a rear of the image forming apparatus and a second paper discharge to discharge paper toward a front of the image forming apparatus, the image forming apparatus including a main body, a first guide member rotatably coupled to the main body to rotate between a first position in which the first guide member defines a portion of the first discharge path and a second position in which the guide member defines a portion of the second discharge path, and a second guide member rotatably coupled to the first guide member such that the second guide member rotates in linkage with the first guide member when the first guide member rotates a first portion of an angle from the first position to the second position and the second guide member rotates independent of the first guide member when the first guide member rotates a remaining portion of the angle from the first position to the second position.

The image forming apparatus may include a retainer protruding from a surface of the first guide member, and a hook formed on the second guide member and configured to couple to the retainer to cause the second guide member to rotate in linkage with the first guide member when the first guide member rotates a first portion of the angle from the first position to the second position.

The image forming apparatus may include a lever including a protrusion portion configured to abut against the second guide member to cause the second guide member to rotate independent of the first guide member.

The image forming apparatus may include a string member coupled to the second guide member and slidably coupled to the first guide member, the string member configured to receive a user force to cause the second guide member to rotate independent of the first guide member.

The image forming apparatus may include a plurality of guide edges formed on the second guide member to define a portion of the first discharge path when the first guide member is in the first position.

When the first guide member rotates the remaining portion of the angle from the first position to the second position, the second guide member may rotate in an opposite direction of the first guide member.

When the first guide member is in the second position, the second guide member may be disposed so as not to interfere with paper being fed along the second discharge path.

BRIEF DESCRIPTION OF THE DRAWINGS

These and/or other aspects of the invention will become apparent and more readily appreciated from the following description of the embodiments, taken in conjunction with the accompanying drawings of which.

DETAILED DESCRIPTION OF THE PREFERRED EMBODIMENTS

Figure 1:
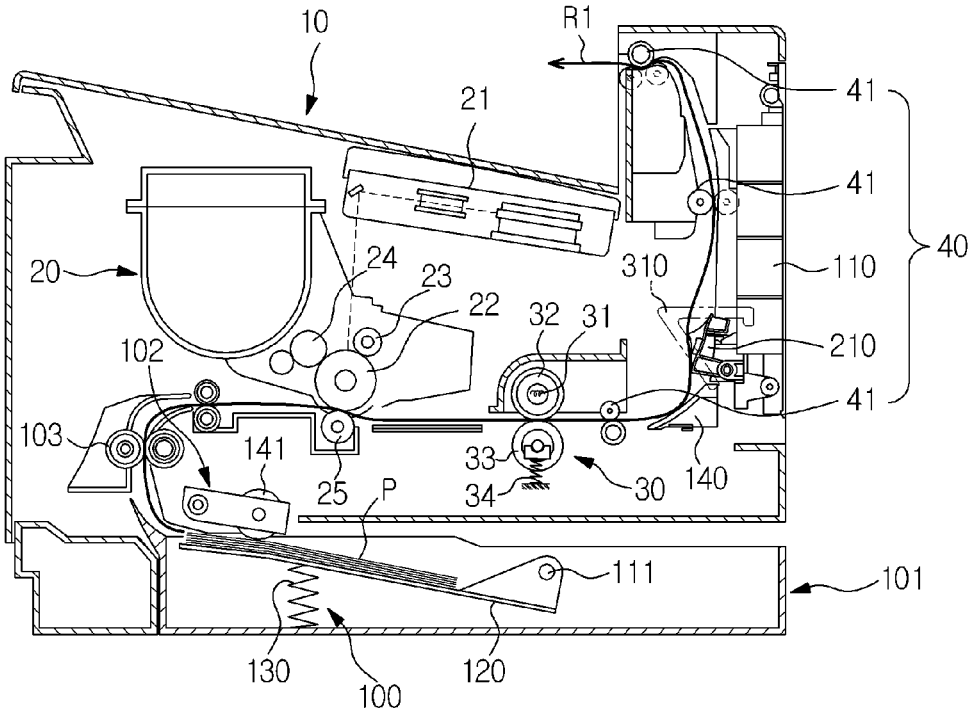
FIG. 1 is a view illustrating the interior of an image forming apparatus including a first paper discharge path according to an exemplary embodiment.

Reference will now be made in detail to the embodiments of the present general inventive concept, examples of which are illustrated in the accompanying drawings, wherein like reference numerals refer to the like elements throughout. The embodiments are described below in order to explain the present general inventive concept while referring to the figures.

Figure 2:
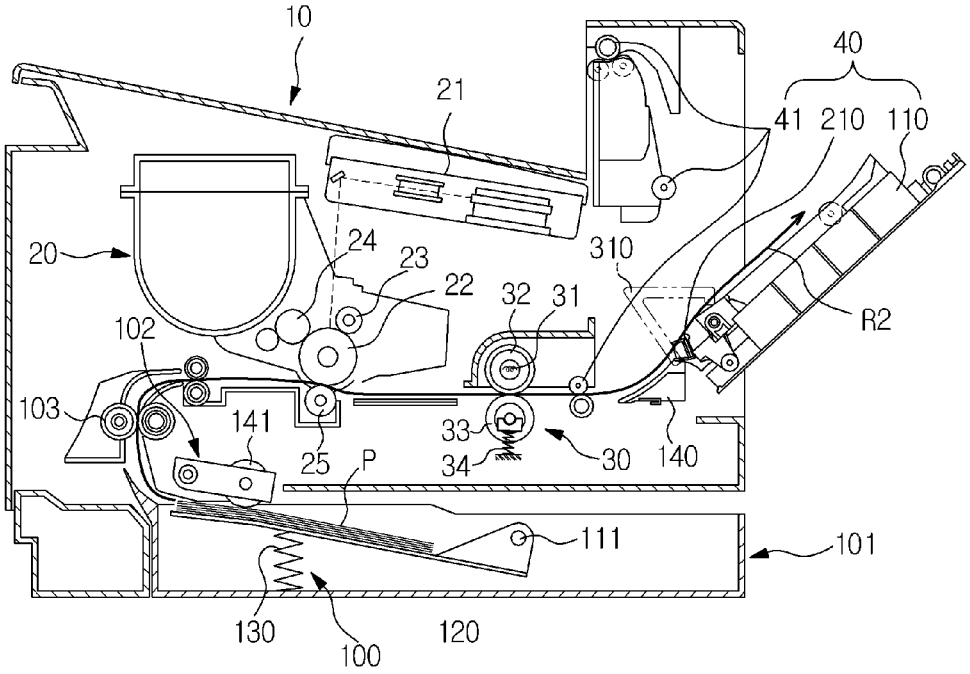
FIG. 2 is a view illustrating the interior of an image forming apparatus including a second paper discharge path according to an exemplary embodiment.

FIG. 1 is a view illustrating the interior of an image forming apparatus including a first paper discharge path according to an exemplary embodiment, and FIG. 2 is a view illustrating the interior of an image forming apparatus including a second paper discharge path according to an exemplary embodiment.

Referring to FIGS. 1 and 2, the image forming apparatus according to the exemplary embodiment includes a main body 10, which defines an outer appearance of the image forming apparatus and supports a variety of elements installed therein, a paper feeding device 100 to feed paper P, a developing device 20 to develop an image on the paper P, a fusing device 30 to fuse the developed image on the paper P by applying heat and pressure to the paper P, and a paper discharge device 40 to discharge the paper on which the image has been completely printed, to the outside of the main body 10. The developing device 20 and the fusing device 30 constitute an image forming mechanism to form an image on paper and are installed within the main body 10.

The paper feeding device 100 includes a paper feeding cassette 101 in which the paper P as print media is stored, a pickup roller assembly 102 to pick up the paper P stored in the paper feeding cassette 101 one by one, and a delivery roller 103 to move the picked up paper to the developing device 20. The paper feeding cassette 101 is detachably coupled to the main body 10. The main body 10 is provided with an opening (not shown) at a front lower end thereof for coupling of the paper feeding cassette 101.

The developing device 20 includes a photoconductor drum 22 on a surface of which an electrostatic latent image is formed by a laser scanning unit 21, a charging roller 23 to charge the photoconductor drum 22, a developing roller 24 to develop the electrostatic latent image formed on the photoconductor drum 22 to a toner image, and a transfer roller 25 to transfer the toner image from the photoconductor drum 22 to the paper by pressing the paper onto the photoconductor drum 22.

The fusing device 30 serves to fuse the toner image onto the paper by applying heat and pressure to the paper. The fusing device 30 includes a heating roller 32 having a heat source 31 to apply heat to the paper, to which the toner image has been transferred, a pressure roller 33 arranged to face the heating roller 32 so as to maintain a constant fusing pressure against the heating roller 32, and a pressure member 34 to elastically bias the pressure roller 33 such that the pressure roller 33 comes into close contact with the heating roller 32.

The paper discharge device 40 includes a series of paper discharge rollers 41 arranged in sequence to deliver the paper, having passed through the fusing device 30, to the top of the main body 10, and a first guide member 110 and second guide member 210 to guide the paper between the paper discharge rollers 41 for smooth delivery of the paper.

Referring to FIG. 1, if the first guide member 110 closes a rear side of the main body 10 (i.e is in a closed position), a first paper discharge path R1 is formed. The first paper discharge path R1 directs the paper to be discharged in a direction of a rear side of the main body 10. Referring to FIG. 2, if the first guide member 110 is pivotally rotated to open the rear side of the main body 10 (i.e. is in an open position), a second paper discharge path R2 is formed. The second paper discharge path R1 directs the paper to be discharged in a direction of a front side of the main body 10.

In the case where the paper is delivered along the first paper discharge path R1, a printed surface of the discharged paper is inverted to face downward. In the case where the paper is delivered along the second paper discharge path R2, the printed surface of the paper is directly discharged to face upward.

Figure 3:
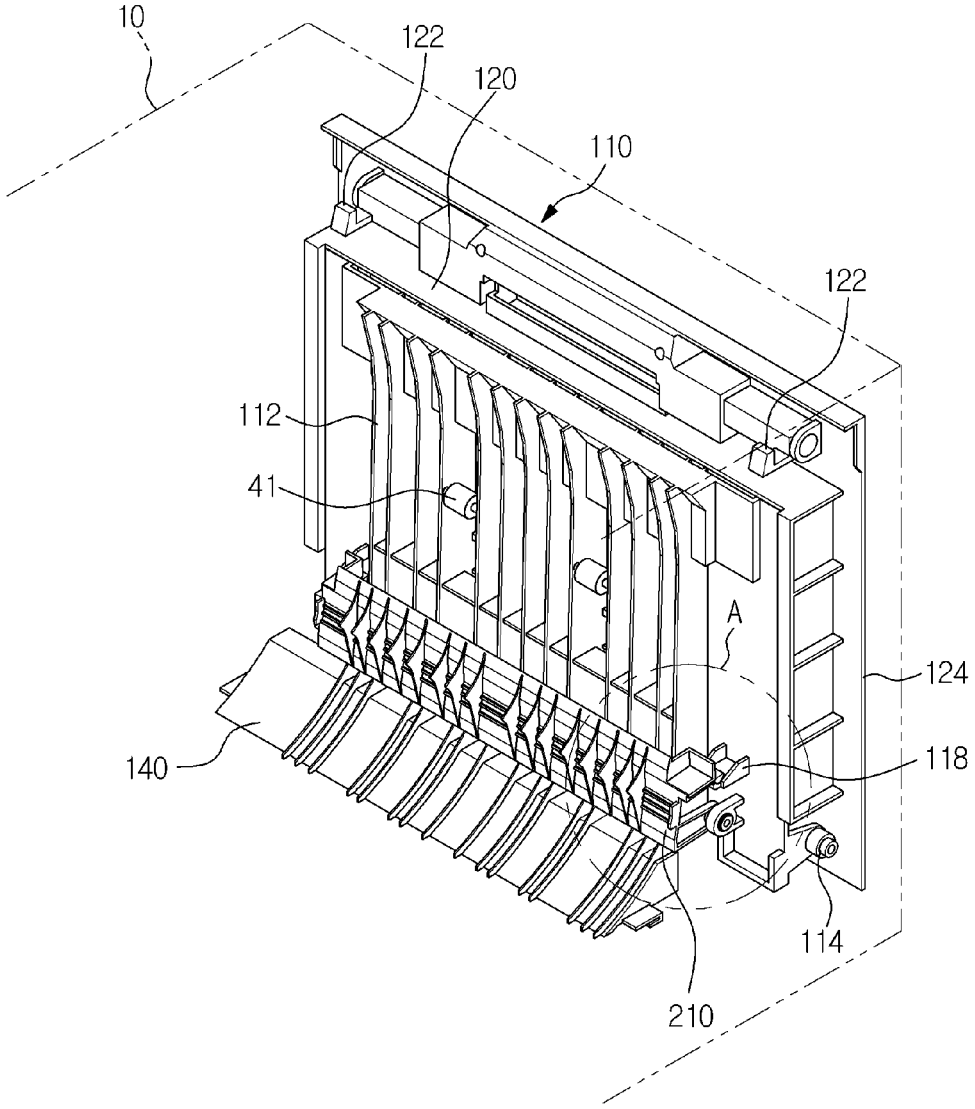
FIG. 3 is a perspective view illustrating a first guide member and a second guide member as distinctive components of the image forming apparatus according to an exemplary embodiment.
Figure 4:
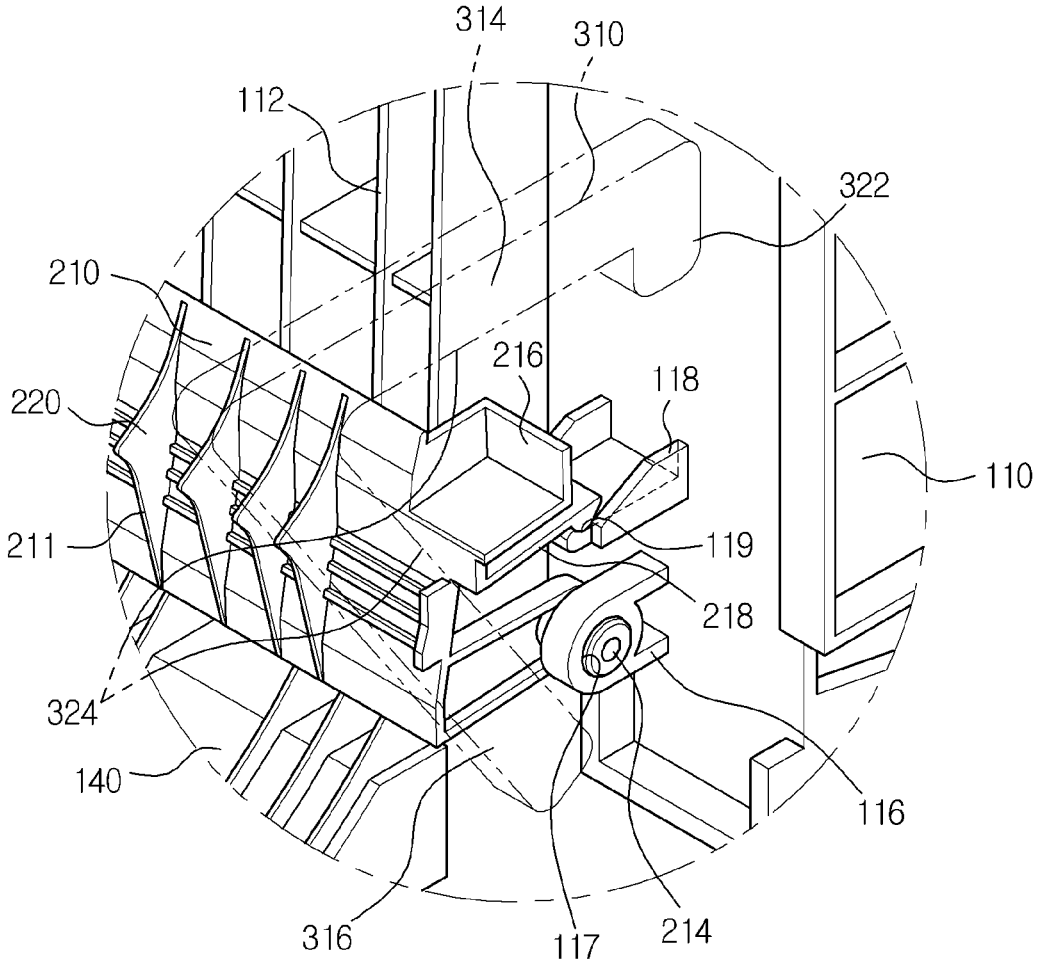
FIG. 4 is an enlarged perspective view of the portion 'A' of FIG. 3.

FIG. 3 is a perspective view illustrating a first guide member 110 and a second guide 210 member as distinctive components of the image forming apparatus according to an exemplary embodiment, and FIG. 4 is an enlarged perspective view of the portion 'A' of FIG. 3.

Referring to FIGS. 3 and 4, the first guide member 110 includes a guide body 120 and a support plate 124 coupled to an outer surface of the guide body 120. The guide body 120 includes a plurality of guide ribs 112, a first hinge 114, a hinge coupling rib 116, and a retainer 118.

The support plate 124 coupled to the outer surface of the guide body 120 serves as a cover to open or close the rear side of the main body 10.

The plurality of guide ribs 112 protrudes from an inner surface of the guide body 120. The guide ribs 112 vertically extend from a lower end to an upper end of the guide body 120 with a predetermined curvature and ensure that the paper is smoothly delivered along the paper discharge path. The paper discharge rollers 41 are mounted between the plurality of guide ribs 112 and deliver the paper along the plurality of guide ribs 112 to the top of the main body 10 while supporting the paper being delivered. The plurality of guide ribs 112 defines the paper discharge path along which the paper is discharged, along with guide edges 211 of the second guide member 210 which will be described later.

The first hinge 114 protrudes from either lateral surface of the guide body 120 and has a circular shape to allow the first guide member 110 to be coupled to the main body 10 such that the first guide member 110 can pivotally rotate about the first hinge 114 with respect to the main body 10.

The hinge coupling rib 116 serves to couple the second guide member 210 to the guide body 120 via a second hinge 214 of the second guide member 210 such that the second guide member 210 can pivotally rotate about the second hinge 214 with respect to the guide body 120. The hinge coupling rib 116 protrudes from the inner surface of the guide body 120 and is located at the outside of the plurality of guide ribs 112. The hinge coupling rib 116 is provided with a first hinge hole 117, into which the second hinge 214 of the second guide member 210 is inserted.

The retainer 118 serves to prevent the second guide member 210 from being freely pivotally rotated about the second hinge 214. The retainer 118 protrudes from the inner surface of the guide body 120 and is provided with a recess 119 having a shape corresponding to that of a hook 218 provided at the second guide member 210. As illustrated in FIGS. 3 and 4, the coupling recess 119 is indented in an end of the retainer 118 to provide the retainer 118 with a raised portion having an increased height in a protruding direction thereof. With this configuration, the retainer 118 prevents the second guide member 210 from being pivotally rotated in a direction in which the retainer 118 and the hook 218 are separated from each other, but does not prevent pivotal rotation of the second guide member 210 in an opposite direction.

The support plate 124 is coupled to the outer surface of the guide body 120 and is provided at an inner surface thereof with at least one coupling protrusion 122. As the coupling protrusion 122 is inserted into a coupling recess (not shown) of the main body 10, the first guide member 110 is prevented from freely pivotally rotating.

The second guide member 210 includes the guide edges 211, an avoidance surface 212 (see FIG. 5A), the second hinge 214, a clasp 216, the hook 218, and a plurality of ribs 220.

The plurality of ribs 220 are provided at one surface of the second guide member 210. Each rib 220 is shaped such that a protruding width of the rib 220 gradually increases from a lower end to a center position of the second guide member 210 and then decreases from the center position to an upper end of the second guide member 210. As such, the rib 220 has at least two slopes.

Of the at least two slopes of the rib 220, the guide edges 211 form one slope extending from the lower end to the center position of the second guide member 210. The guide edges 211 may have a predetermined radius of curvature to smoothly deliver the paper, having passed through a guide boss 140, to the guide ribs 112. The guide edges 211, along with the plurality of guide ribs 112, define the first paper discharge path R1.

The avoidance surface 212 (see FIG. 5A) is the opposite surface of the second guide member 210 with respect to the surface where the plurality of ribs 220 are arranged. The avoidance surface 212 prevents the pivotally rotated second guide member 210 from interfering with the paper to be discharged along the second paper discharge path R2 when the first guide member 110 is pivotally rotated to create the second paper discharge path R2. The avoidance surface 212 may have a greater radius of curvature than the radius of curvature of the guide edges 211.

The second hinge 214 is provided at either lateral surface of the second guide member 210. As the second hinge 214 is inserted into the first hinge hole 117 of the hinge coupling rib 116, the second guide member 210 is coupled to the guide body 120 such that the second guide member 210 can pivotally rotate with respect to the guide body 120.

The clasp 216 extends laterally from one side of the second guide member 210 and the hook 218 is provided at a lower end of the clasp 216. If the clasp 216 comes into contact with a lever 310, which will be described later, in a state in which the second guide member 210 is fixed to the first guide member 110, the clasp 216 applies force to the hook 218 caught by the recess 119 of the retainer 118 so as to release the hook 218 from the recess 119, thereby allowing the second guide member 210 to be pivotally rotated in linkage with pivotal rotation of the first guide member 110 while limiting a pivotal rotation range of the second guide member 210 to prevent the second guide member 210 from being excessively pivotally rotated.

The hook 218 is located at a position corresponding to the retainer 118 such that an end of the hook 218 is caught by the recess 119. If no external force is applied in a state in which the hook 218 is caught by the retainer 118, the hook 218 is prevented from moving in a direction in which the hook 218 is released from the retainer 118, but is not prevented from moving in an opposite direction.

The lever 310 causes the second guide member 210 to be pivotally rotatable in linkage with the first guide member 110. As illustrated in FIG. 4, the lever 310 is shaped to surround the clasp 216 provided at one side of the second guide member 210 and is positioned within the main body 10 to intermittently come into contact with a front surface and a rear surface of the clasp 216.

The lever 310 includes a first pressure portion 314, a second pressure portion 316, and a pressure protrusion 322 defining a shape of the lever 310. The pressure protrusion 322 is provided at one end of the first pressure portion 314. A pressure surface 324 defines an inner surface of the first pressure portion 314 and the second pressure portion 316.

The first pressure portion 314 and the second pressure portion 316 may be integrally formed with each other to have an acute angle therebetween.

The pressure protrusion 322 provided at one end of the first pressure portion 314 applies pressure to the front surface of the clasp 216, causing the hook 218 to be released from the retainer 118. The pressure surface 324 defining the inner surface of the first pressure portion 314 and the second pressure portion 316 may apply pressure to the rear surface of the clasp 216, causing the hook 218 and the retainer 118 to be coupled with each other, or may support the rear surface of the clasp 216 to limit a pivotal rotation angle of the second guide member 210.

Hereinafter, an operation principle of the first guide member 110 and the second guide member 210 to define the paper discharge path will be described.

Figure 5A:
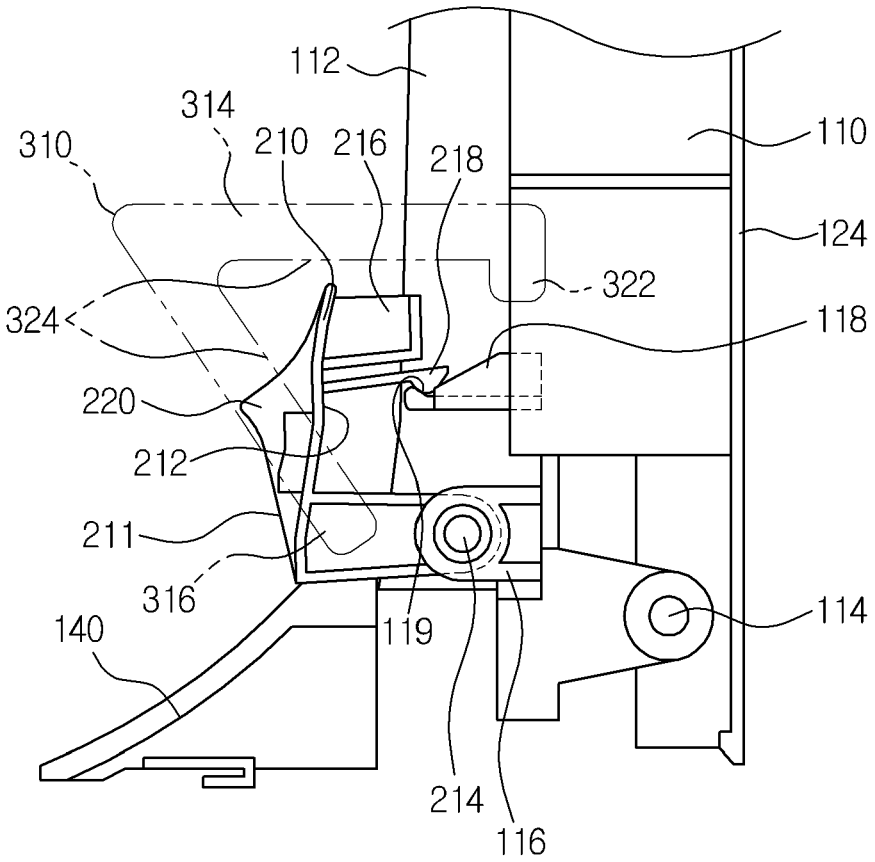
FIGS. 5A to 5C are views illustrating a process of creating the second paper discharge path by pivotally rotating the first guide member and the second guide member using a lever.
Figure 5B:
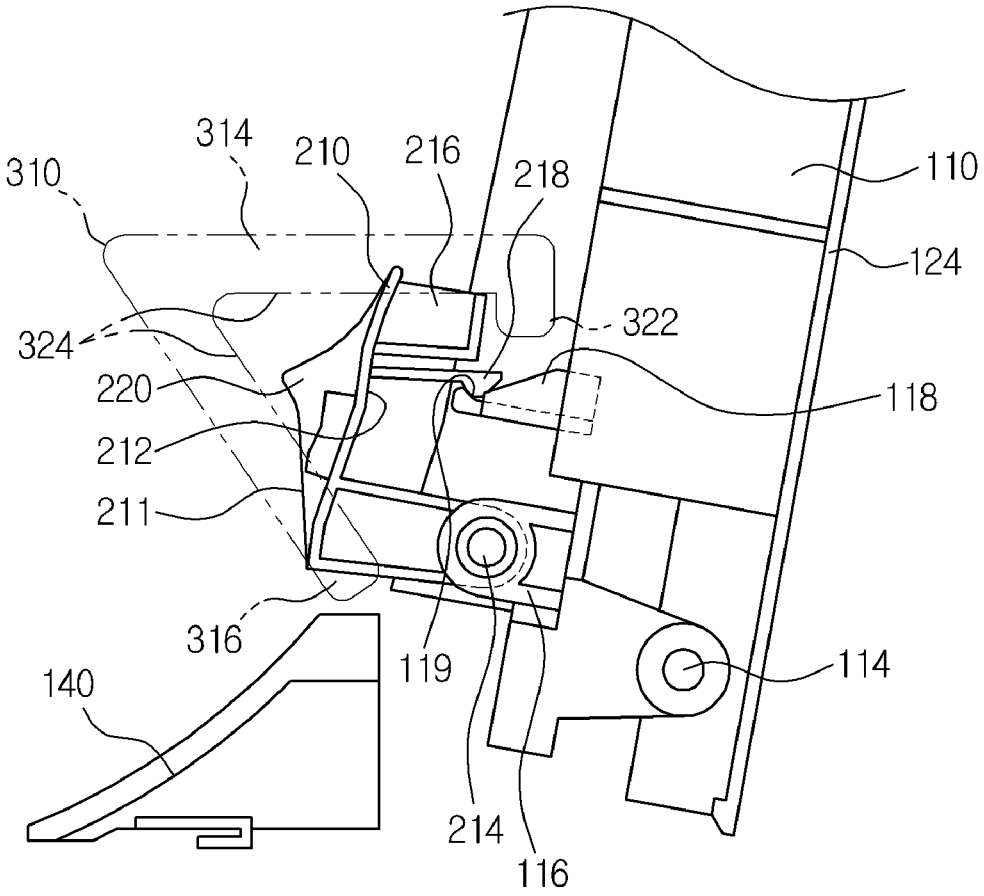
Figure 5C:
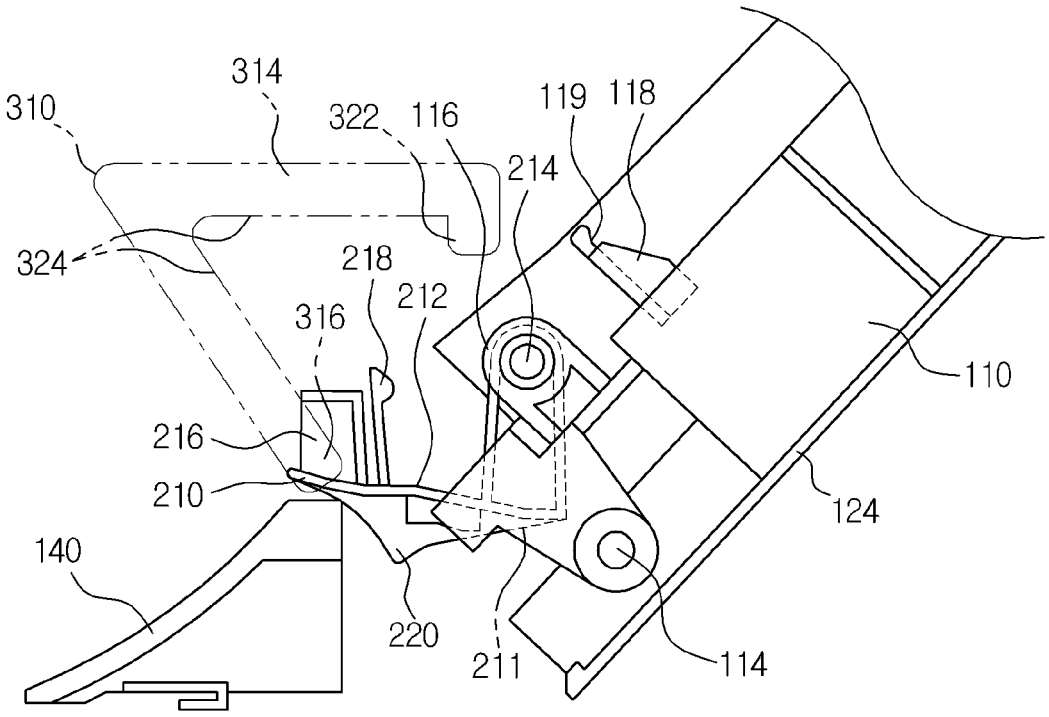

FIGS. 5A to 5C are views illustrating a process of creating the second paper discharge path by pivotally rotating the first guide member 110 and the second guide member 210 using the lever 310.

As illustrated in FIG. 5A, if the first guide member 110 closes the rear side of the main body 10 (i.e. is in a closed position), the second guide member 210 is arranged substantially parallel to the first guide member 110 and the avoidance surface 212 is arranged to face the first guide member 110.

Since the hook 218 of the second guide member 210 is caught by the retainer 118 of the first guide member 110, the second guide member 210 is prevented from pivotally rotating in a direction in which the hook 218 is released from the retainer 118.

While the first guide member 110 closes the rear side of the main body 10 (i.e. is in a closed position), the guide edges 211, guide ribs 112 and paper discharge rollers 41 define the first paper discharge path R1. The paper, having passed through the fusing device 30 and the guide boss 140, is delivered to the top of the main body 10 by way of the guide edges 211 and the guide ribs 112. The second guide member 210 is slightly rotated in an opposite direction of a direction in which the hook 218 is released from the retainer 118, i.e. in a clockwise direction at a time when the paper passes the guide edges 211, allowing the paper to be naturally delivered without being bent.

As illustrated in FIG. 5B, if the first guide member 110 is rotated by a predetermined angle in a direction in which the first guide member 110 opens the main body 10, the second guide member 210 is brought into contact with the lever 310. More particularly, the pressure protrusion 322 provided at the first pressure portion 314 of the lever 310 is brought into contact with the front surface of the clasp 216.

The second guide member 210 is pivotally rotated along with the first guide member 110 until the first guide member 110 reaches the predetermined angle because the retainer 118 of the pivotally rotating first guide member 110 acts to pivotally rotate the hook 218 caught thereby.

As illustrated in FIG. 5C, if the first guide member 110 is completely pivotally rotated to open the rear side of the main body 10 (i.e. is in an open position), the avoidance surface 212 is arranged obliquely to the first guide member 110.

Once the first guide member 110 is pivotally rotated by the predetermined angle in a direction in which the first guide member opens the main body 10, the lever 310 applies pressure to the second guide member 210, causing the second guide member 210 to be pivotally rotated in an opposite direction of the pivotal rotating direction of the first guide member 110. More particularly, the pressure protrusion 322 applies pressure to the front surface of the clasp 216 to release the hook 218 from the retainer 118, causing the second guide member 210 to be freely pivotally rotated in an opposite direction of the pivotal rotating direction of the first guide member 110.

The second guide member 210 stops pivotally rotating when coming into contact with the second pressure portion 316 of the lever 310. In this case, the pressure surface 324 defining the inner surface of the second pressure portion 316 supports the rear surface of the clasp 216, keeping the second guide member 310 in contact with the second pressure portion 316.

In the case where the first guide member 110 opens the rear side of the main body 10, the guide ribs 112 and the paper discharge rollers 41 define the second paper discharge path R2. The paper, having passed through the fusing device 30 and the guide boss 140, is stacked over the guide ribs 112 without interference from the avoidance surface 212.

An empty space, which is created as the second guide member 210 is pivotally rotated in an opposite direction of the pivotal rotating direction of the first guide member 110, provides an increased paper loading space, which may prevent a print defect, such as paper curling, because the paper can be loaded over the guide ribs 112 without being bent.

On the other hand, in the case where the first guide member 110, which has been kept in the open position, is pivotally rotated to the closed position to define the first paper discharge path R1, the pressure surface 324 of the lever 310 applies pressure to the rear surface of the clasp 216, causing the second guide member 210 to be pivotally rotated in an opposite direction of the pivotal rotating direction of the first guide member 110 until the hook 218 is caught by the retainer 118. As such, the second guide member 210 is returned to the position illustrated in FIG. 5A.

The lever 310 is not essential to realize the embodiment. The lever 310 allows the second guide member 210 to be pivotally rotated in linkage with the first guide member 110 when the first guide member 110 and the second guide member 210 are pivotally rotated to define the first paper discharge path R1 or the second paper discharge path R2. Instead of providing the lever 310, the second guide member 210 may be manually pivotally rotated by applying a predetermined force to the clasp 216 of the second guide member 210 so as to release or couple the hook 218 from or to the retainer 118.

Figure 6:
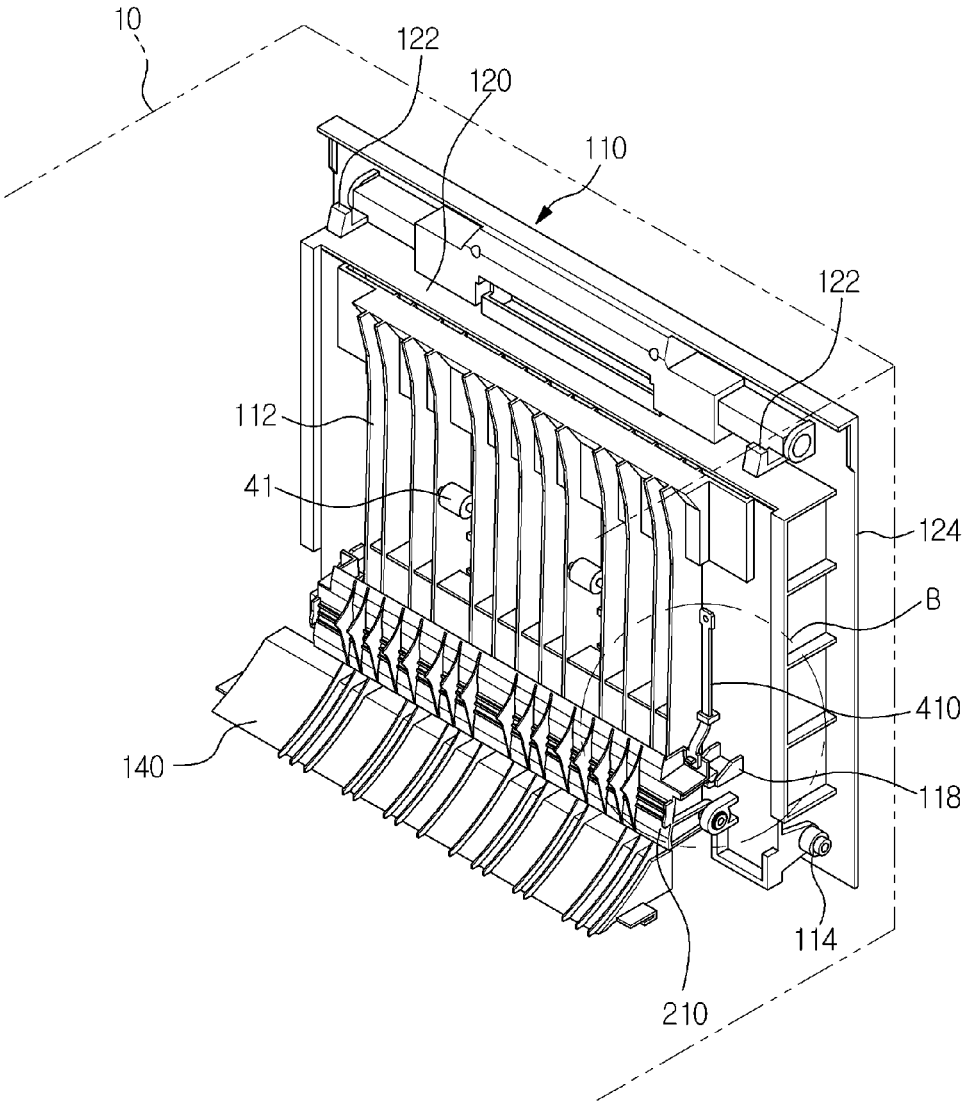
FIG. 6 is a perspective view illustrating a first guide member and a second guide member of the image forming apparatus according to an exemplary embodiment.
Figure 7:
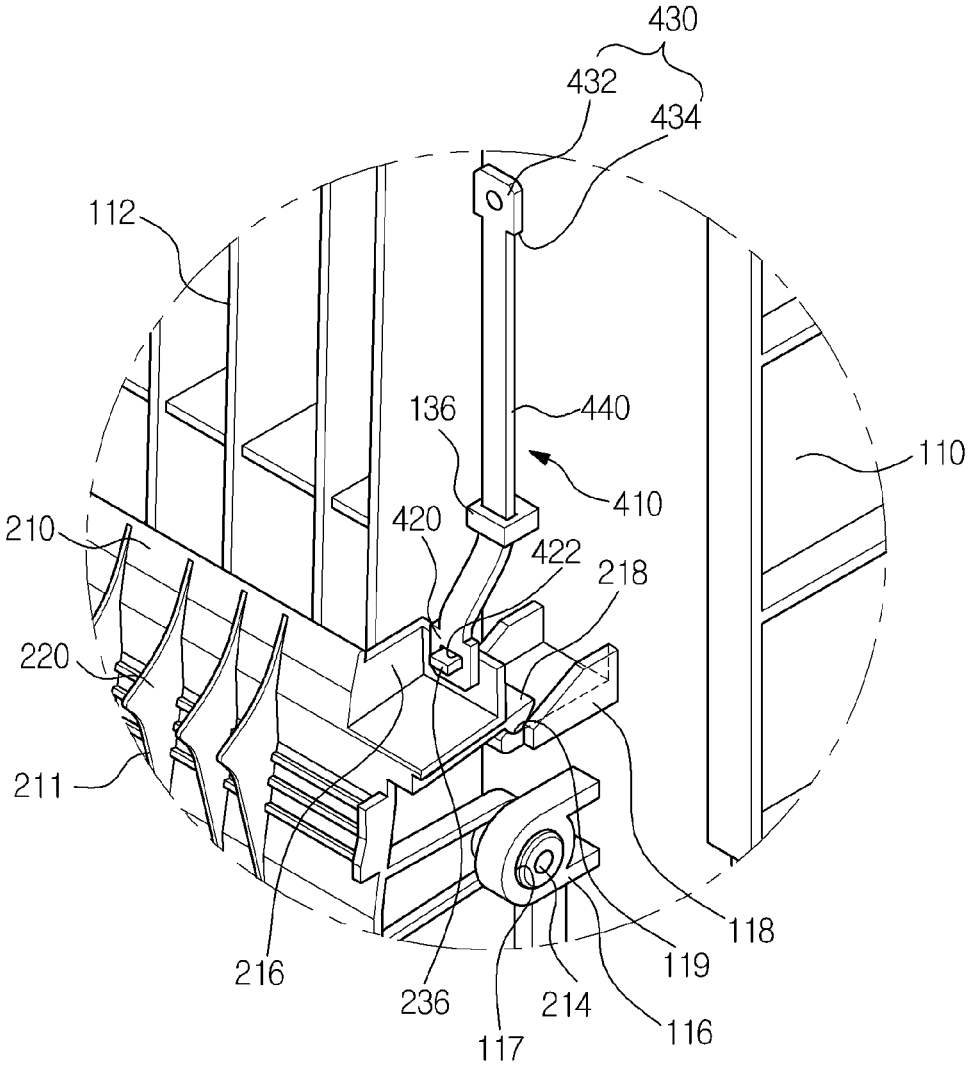
FIG. 7 is an enlarged perspective view of the portion 'B' of FIG. 6.
Figure 8A:
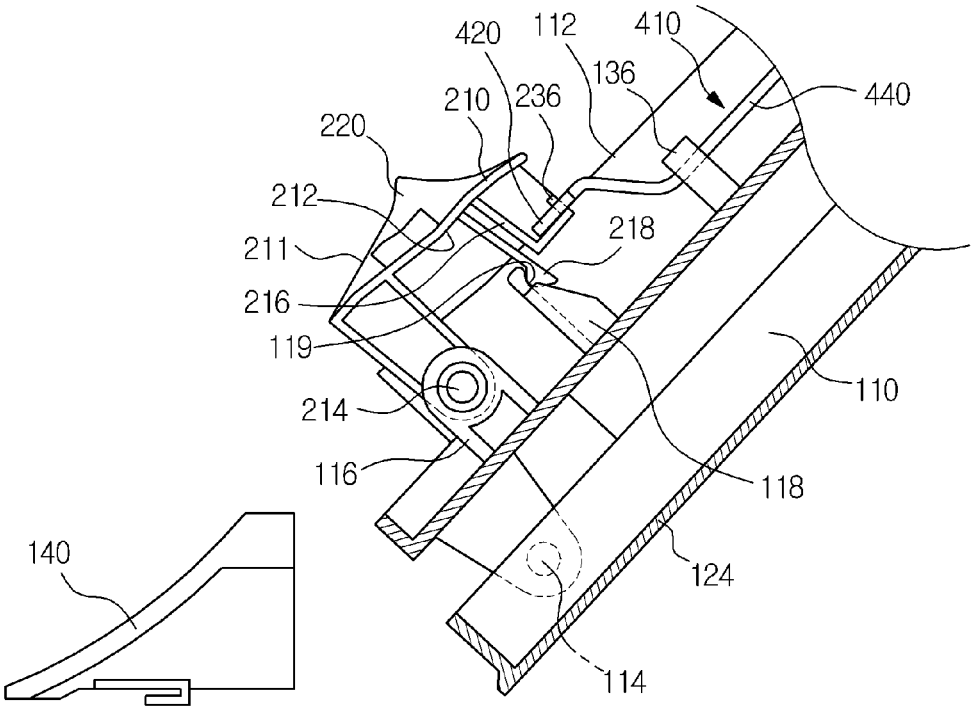
FIGS. 8A and 8B are views illustrating a process of creating the second paper discharge path by pivotally rotating the first guide member and the second guide member using the string member.
Figure 8B:
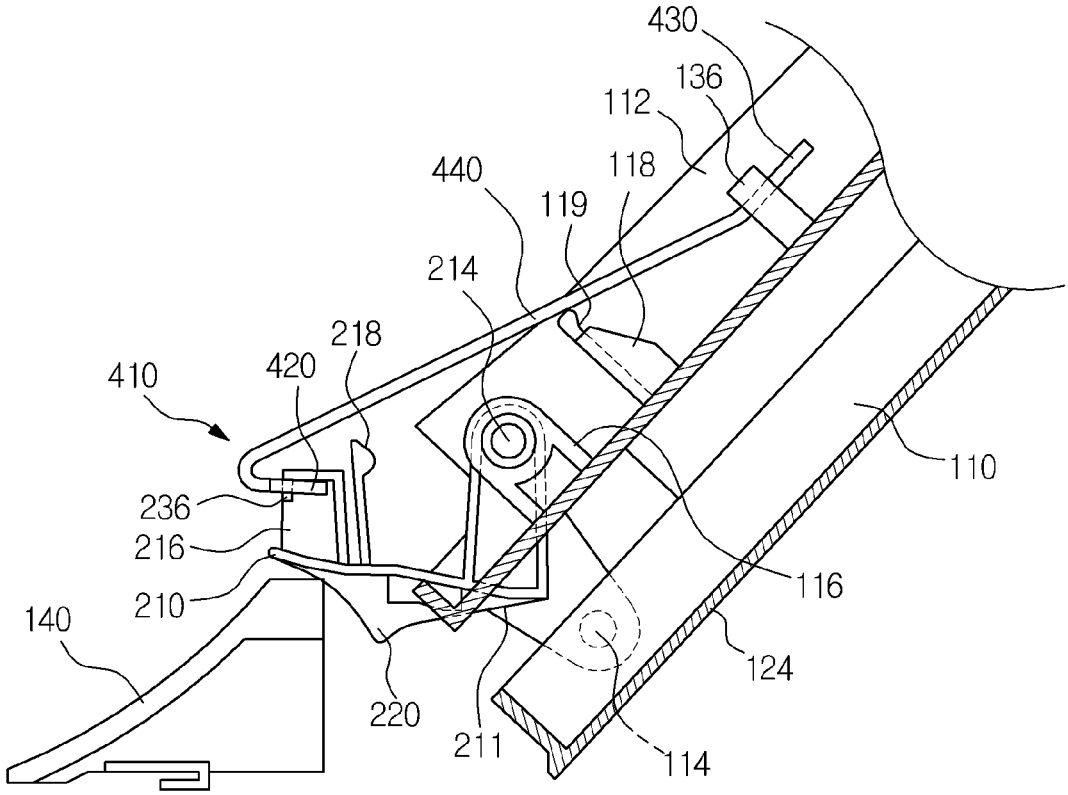

FIG. 6 is a perspective view illustrating a first guide member 110 and a second guide member 210 according to an exemplary embodiment. The exemplary embodiment illustrated in FIG. 6 is similar to the exemplary embodiment illustrated in FIG. 3 except that instead of a lever, a string member 410 is provided. FIG. 7 is an enlarged perspective view of the portion 'B' of FIG. 6. Also, FIGS. 8A and 8B are views illustrating a process of creating the second paper discharge path by pivotally rotating the first guide member and the second guide member using the string member.

As illustrated in FIGS. 6 to 8B, the string member 410 is coupled to the second guide member 210 and slidably coupled to the first guide member 110, and serves to pivotally rotate the second guide member 210.

The string member 410 includes a coupling portion 420 coupled to the second guide member 210, a grip portion 430 that the user will grip, and a connecting portion 440 to connect the coupling portion 420 and the grip portion 430 to each other. The coupling portion 420, connecting portion 440 and grip portion 430 constitute a single body.

The coupling portion 420 is provided with a coupling hole 422 through which the string member 410 is coupled to the second guide member 210.

The clasp 216 of the second guide member 210 is provided with a coupling piece 236. The coupling piece 236 protrudes from the rear surface of the clasp 216 and has a shape corresponding to that of the coupling hole 422 so as to be fitted into the coupling hole 422.

The connecting portion 440 reciprocally moves in a space defined by the first guide member 110 and a stopper 136 which will be described hereinafter, and transmits force applied to the grip portion 430 by the user to the coupling portion 420.

The grip portion 430 includes a grip 432 to allow the user to easily grip the string member 410 and a stepped portion 434. If the stepped portion 434 comes into contact with the stopper 136, the grip portion 430 is caught by the stopper 136, preventing movement of the string member 410.

The stopper 136 is provided at the inner surface of the first guide member 110. The stopper 136 is shaped to surround the connecting portion 440 of the string member 410 while allowing the connecting portion 440 to reciprocally move along with the first guide member 110. If the stopper 136 comes into contact with the stepped portion 434 of the grip portion 430, the stopper 136 prevents movement of the string member 410 and consequently, prevents pivotal rotation of the second guide member 210 connected to the string member 410. As illustrated in FIG. 8B, the stepped portion 434 of the grip portion 430 is in contact with the stopper 136 such that the string member 410 restricts further rotation of the second guide member 210.

Referring to FIG. 8A, the hook 218 of the second guide member 210 is caught by the retainer 118. At this point, if a user force is applied to the string member 410 to cause the hook 218 to release from the retainer 118, the second guide member 210 will rotate independent of the first guide member 110 to the position illustrated in FIG. 8B.

Referring to FIG. 8B, the second guide member 210 has rotated in a direction opposite of the first guide member 110. The grip portion 430 contacts the stopper 136 such that the second guide member 210 is restricted from rotating further from the first guide member 110. From the position illustrated in FIG. 8B, a user may apply force to the grip portion 430 of the string member 410 to pull the string member 410 and cause the second guide member 210 to rotate back to a position where the hook 218 is caught by the retainer 118, as illustrated in FIG. 8A.

If the string member 410 connected to the second guide member 210 is pulled to pivotally rotate the second guide member 210 until the hook 218 is caught by the retainer 118 and thereafter, the first guide member 110 is pivotally rotated to close the main body 10 and is coupled to the main body 10, the first paper discharge path R1 is provided.

Once the second paper discharge path R2 is provided as the first guide member 110 is completely pivotally rotated to open the main body 10, the string member 410 is pushed such that the hook 218 is released from the retainer 118 and then, the second guide member 210 is pivotally rotated until the stepped portion 434 comes into contact with the stopper 136, preventing the first guide member 110 from interfering with the paper discharged along the second paper discharge path R2.

As described above, the user can manually pivotally rotate the second guide member 210, and using the string member 410 may ensure that the user can more conveniently pivotally rotate the second guide member 210.

As is apparent from the above description, one or more embodiments include an image forming apparatus, which may prevent a print defect occurring when print media is stacked on a paper discharge path in a bent state.

Further, the image forming apparatus may ensure that a sufficient number of sheets of print media are stacked on a paper discharge path.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. An image forming apparatus having a first paper discharge path to discharge paper in which a printed surface of the paper is inverted, and a second paper discharge path, along which the printed surface of the paper is directly discharged, the image forming apparatus comprising:

a main body;

a first guide member coupled to the main body so as to be pivotally rotated from a first position to a second position; and a second guide member coupled to the first guide member such that the second guide member can pivotally rotate with respect to the first guide member, wherein the first guide member defines the first paper discharge path when it is in the first position and the second paper discharge path when it is pivotally rotated from the first position to the second position, and wherein the second guide member includes a guide edge to guide the paper to be discharged along the first paper discharge path and does not interfere with the paper to be discharged along the second paper discharge path, wherein the second guide member includes an avoidance surface to prevent the second guide member from interfering with the paper to be discharged along the second paper discharge path, and wherein the avoidance surface is arranged to face the first guide member so as to guide the paper on the first paper discharge path when the first guide member is in the first position, and is arranged obliquely to the first guide member so as not to interfere with the paper on the second paper discharge path when the first guide member is located in the second position.

2. The apparatus according to claim 1, wherein the avoidance surface has a greater radius of curvature than a radius of curvature of the guide edge.

3. An image forming apparatus having a first paper discharge path to discharge paper in which a printed surface of the paper is inverted, and a second paper discharge path, along which the printed surface of the paper is directly discharged, the image forming apparatus comprising:

a main body;

a first guide member coupled to the main body so as to be pivotally rotated from a first position to a second position; and a second guide member coupled to the first guide member such that the second guide member can pivotally rotate with respect to the first guide member, wherein the first guide member defines the first paper discharge path when it is in the first position and the second paper discharge path when it is pivotally rotated from the first position to the second position, and wherein the second guide member includes a guide edge to guide the paper to be discharged along the first paper discharge path and does not interfere with the paper to be discharged along the second paper discharge path, wherein the second guide member includes a clasp protruding from one side thereof and a hook provided near the clasp, and wherein the first guide member includes a retainer provided at a position corresponding to the hook.

4. The apparatus according to claim 3, wherein the hook is coupled with the retainer when the first guide member is in the first position and is released from the retainer when the first guide member is in the second position.

5. The apparatus according to claim 3, further comprising a lever provided in the main body, wherein the lever includes:

a first pressure portion to apply pressure to a front surface of the clasp so as to pivotally rotate the second guide member when the first guide member is pivotally rotated from the first position to the second position; and a second pressure portion to apply pressure to a rear surface of the clasp so as to pivotally rotate the second guide member when the first guide member is pivotally rotated from the second position to the first position.

6. The apparatus according to claim 5, wherein the second pressure portion comes into contact with a rear surface of the second guide member to restrict pivotal rotation of the second guide member when the first guide member is in the second position.

7. The apparatus according to claim 6, wherein the first pressure portion and the second pressure portion are integrally formed with each other to have an acute angle therebetween.

8. The apparatus according to claim 7, wherein the second guide member is pivotally rotated in an opposite direction of a pivotal rotating direction of the first guide member when the first guide member is pivotally rotated between the first position and the second position.

9. The apparatus according to claim 3, further comprising a string provided at one surface of the first guide member, wherein the string includes:

a coupling portion coupled to the second guide member;

a grip portion to receive a user force to pull the string; and a connecting portion to connect the coupling portion and the grip portion to each other.

10. The apparatus according to claim 9, wherein the clasp includes a coupling piece protruding from a rear surface thereof, and wherein the coupling portion is provided with a coupling hole to couple with the coupling piece.

11. The apparatus according to claim 10, wherein the first guide member is provided at one surface thereof with a stopper, the stopper being shaped to surround the connecting portion.

12. The apparatus according to claim 11, wherein the grip portion and the stopper come into contact with each other to restrict pivotal rotation of the second guide member.

13. An image forming apparatus having paper discharge paths along which paper is discharged, the image forming apparatus comprising:

a main body;

a cover rotatably coupled to the main body to open or close the main body, the cover being rotatable between a closed position and an open position;

a guide rib provided at an inner surface of the cover; and a rotating member rotatably coupled to the cover, wherein the guide rib defines a first paper discharge path when the cover is in the closed position and a second paper discharge path when the cover is rotated from the closed position to the open position, and wherein the rotating member includes at least one guide edge extending from a surface thereof to guide the paper to be discharged along the first paper discharge path and does not interfere with the paper to be discharged along the second paper discharge path.

14. The apparatus according to claim 13, wherein the rotating member includes:

the at least one guide edge to define the first paper discharge path along with the guide rib when the cover is in the closed position; and an avoidance surface arranged so as not to interfere with the paper to be discharged along the second paper discharge path when the cover is in the open position to define the second paper discharge path.

15. The apparatus according to claim 14, wherein the avoidance surface has a greater radius of curvature than a radius of curvature of the guide edge.

16. The apparatus according to claim 14, further comprising:

a clasp provided at one side of the rotating member;

a hook provided beneath the clasp; and a retainer protruding from the inner surface of the cover and having a recess having a shape corresponding to that of the hook, wherein the hook is coupled with the recess when the cover is in the closed position and is released from the recess when the cover is in the open position.

17. The apparatus according to claim 16, further comprising a lever to rotate the rotating member, wherein the lever includes:

a guide body;

a pressure protrusion formed at one end of the guide body; and a pressure surface defining an inner surface of the guide body, wherein the pressure protrusion applies pressure to a front surface of the clasp such that the rotating member is rotated in an opposite direction of a rotating direction of the cover when the cover is rotated from the closed position to the open position, and wherein the pressure surface applies pressure to a rear surface of the clasp such that the rotating member is rotated in an opposite direction of a rotating direction of the cover when the cover is rotated from the open position to the closed position.

18. The apparatus according to claim 17, wherein the pressure surface comes into contact with a rear surface of the rotating member to restrict pivotal rotation of the rotating member when the cover is in the open position.

19. The apparatus according to claim 14, further comprising a string member to rotate the rotating member, wherein the string member includes:

a body;

a coupling hole formed in one end of the body to couple the string member to the rotating member; and a grip provided at the other end of the body to receive a user force to pull the string member.

20. The apparatus according to claim 19, wherein the clasp includes a coupling piece protruding from a rear surface thereof so as to be fitted into the coupling hole.

21. The apparatus according to claim 20, wherein the rotating member is rotated in linkage with the string member when the string member is pulled by the user.

22. The apparatus according to claim 21, wherein the cover is provided at the inner surface thereof with a stopper, and wherein the stopper and the grip come into contact with each other to restrict rotation of the rotating member.

23. An image forming apparatus having a first paper discharge path to discharge paper toward a rear of the image forming apparatus and a second paper discharge to discharge paper toward a front of the image forming apparatus, the image forming apparatus comprising:

a main body;

a first guide member rotatably coupled to the main body to rotate between a first position in which the first guide member defines a portion of the first discharge path and a second position in which the first guide member defines a portion of the second discharge path; and a second guide member rotatably coupled to the first guide member such that the second guide member does not rotate with respect to the first guide member when the first guide member rotates a first portion of an angle from the first position to the second position and the second guide member rotates independent of and away from the first guide member when the first guide member rotates a remaining portion of the angle from the first position to the second position.

24. An image forming apparatus having a first paper discharge path to discharge paper toward a rear of the image forming apparatus and a second paper discharge to discharge paper toward a front of the image forming apparatus, the image forming apparatus comprising:

a main body;

a first guide member rotatably coupled to the main body to rotate between a first position in which the first guide member defines a portion of the first discharge path and a second position in which the first guide member defines a portion of the second discharge path; and a second guide member rotatably coupled to the first guide member such that the second guide member rotates in linkage with the first guide member when the first guide member rotates a first portion of an angle from the first position to the second position and the second guide member rotates independent of the first guide member when the first guide member rotates a remaining portion of the angle from the first position to the second position:

a retainer protruding from a surface of the first guide member; and a hook formed on the second guide member and configured to couple to the retainer to cause the second guide member to rotate in linkage with the first guide member when the first guide member rotates a first portion of the angle from the first position to the second position.

25. The image forming apparatus according to claim 24, further comprising:

a lever including a protrusion portion configured to abut against the second guide member to cause the second guide member to rotate independent of the first guide member.

26. An image forming apparatus having a first paper discharge path to discharge paper toward a rear of the image forming apparatus and a second paper discharge to discharge paper toward a front of the image forming apparatus, the image forming apparatus comprising:

a main body;

a first guide member rotatably coupled to the main body to rotate between a first position in which the first guide member defines a portion of the first discharge path and a second position in which the first guide member defines a portion of the second discharge path;

a second guide member rotatably coupled to the first guide member such that the second guide member rotates in linkage with the first guide member when the first guide member rotates a first portion of an angle from the first position to the second position and the second guide member rotates independent of the first guide member when the first guide member rotates a remaining portion of the angle from the first position to the second position; and a string member coupled to the second guide member and slidably coupled to the first guide member, the string member configured to receive a user force to cause the second guide member to rotate independent of the first guide member.

27. The image forming apparatus according to claim 26, further comprising:

a plurality of guide edges formed on the second guide member to define a portion of the first discharge path when the first guide member is in the first position.

28. The image forming apparatus according to claim 26, wherein when the first guide member rotates the remaining portion of the angle from the first position to the second position, the second guide member rotates in an opposite direction of the first guide member.

29. The image forming apparatus according to claim 26, wherein when the first guide member is in the second position, the second guide member is disposed so as not to interfere with paper being fed along the second discharge path.

* * * * *